US005382138A

United States Patent [19]

Chilton

[11] Patent Number: 5,382,138

[45] Date of Patent: Jan. 17, 1995

[54] DEVICE FOR EMPTYING THE SEWAGE HOLDING TANK OF A BOAT

[76] Inventor: Daniel T. Chilton, 400 Foulk Rd., Wilmington, Del. 19803

[21] Appl. No.: 990,070

[22] Filed: Jan. 29, 1993

[51] Int. Cl.[6] ..... F02B 21/00

[52] U.S. Cl. ..... 417/234; 417/316; 417/364; 180/19.1; 280/47.371

[58] Field of Search ..... 417/234 D, 239, 316, 417/364; 180/19.1, 19.2, 19.3, 6.2; 114/183 R; 137/351; 285/319; 134/166 R, 167 R, 169 R, 111; 184/1.5; 280/47.371

[56] References Cited

U.S. PATENT DOCUMENTS

| | | | |
|---|---|---|---|
| 179,993 | 7/1876 | Bradley . | |
| 1,891,408 | 12/1932 | Gorman . | |
| 2,603,312 | 7/1952 | Tabet | 184/1.5 |
| 3,033,311 | 5/1962 | Edgar et al. | 184/1.5 |
| 3,430,730 | 3/1969 | Kitajima | 184/1.5 |
| 3,751,187 | 8/1973 | Williams | 417/234 |
| 4,370,108 | 1/1983 | Brill | 417/430 |
| 4,685,868 | 8/1987 | Bodensteiner et al. | 417/405 |
| 4,878,339 | 11/1989 | Marier et al. | 180/19.1 |
| 5,168,601 | 12/1992 | Liu | 280/47.371 |
| 5,226,679 | 7/1993 | Klinger | 285/319 |

*Primary Examiner*—Richard A. Bertsch
*Assistant Examiner*—Charles G. Freay
*Attorney, Agent, or Firm*—Connolly and Hutz

[57] ABSTRACT

A device for emptying the sewage holding tank of a boat. The device would have a frame, a tank mounted to the frame for the storage of sewage from the boat. In addition an engine would be mounted to the frame with the engine operating a pump also mounted to the frame. There would be at least one pair of hoses, with one hose, the discharge hose, having one end connected to the tank and the other end mounted to said pump. The second hose, the intake hose, could have one end mounted to the pump and the other end free. There would also be at least one pair of wheels mounted to and extending at least partially below the frame to facilitate the transportability of the device.

15 Claims, 2 Drawing Sheets

DEVICE FOR EMPTYING THE SEWAGE HOLDING TANK OF A BOAT

BACKGROUND OF THE INVENTION

Federal law prohibits the discharge of untreated sewage into any water withing 3 miles of the continental United States. Many pleasure boats have permanently installed toilets which cannot treat the sewage but can only pump the effluent into a holding tank or overboard. There are few pumpout facilities, which are usually located on a crowded marina fuel dock, and are inconvenient, so are seldom used. Thus the waste is discharged overboard in violation of the law and which also pollutes the waterways. Many difficulties would be encountered in developing a device which could empty such sewage holding tanks. Such difficulties would result from many marinas having narrow gates and access or docks. Additionally many marinas have steep approaches to their docks. Further the docks may be of irregular, uneven or deteriorating condition.

SUMMARY OF THE INVENTION

An object of this invention is to have a device capable of pumping out the sewage of the boats at the marinas.

Another object of this invention is to have a device that could be self propelled and capable of maneuvering on any type of dock.

Another object of this invention is to have a method of pumping out the sewage of docked boats.

The invention describes a self propelled device for emptying the boat holding tank. The device is narrow, thereby being usable with marinas which have narrow gates and access or docks. Because the device is self propelled, it may be used with marinas which have steep approaches to their docks despite the device being of great weight when full. The device is maneuverable with a high ground clearance to negotiate sharp turns, and uneven and deteriorating docks. When empty, the device is light weight with a large tank so the operator of the device can determine how much effluent to pump into the tank before leaving the dock to empty the device into a larger stationary tank. With this device, multiple boats on the same dock can be pumped out without the boat's owner being present.

One of the uses of this device would be to provide regularly scheduled pump out service for boats, much like residential trash collection.

DETAILED DESCRIPTION OF THE INVENTION

Figure 1:
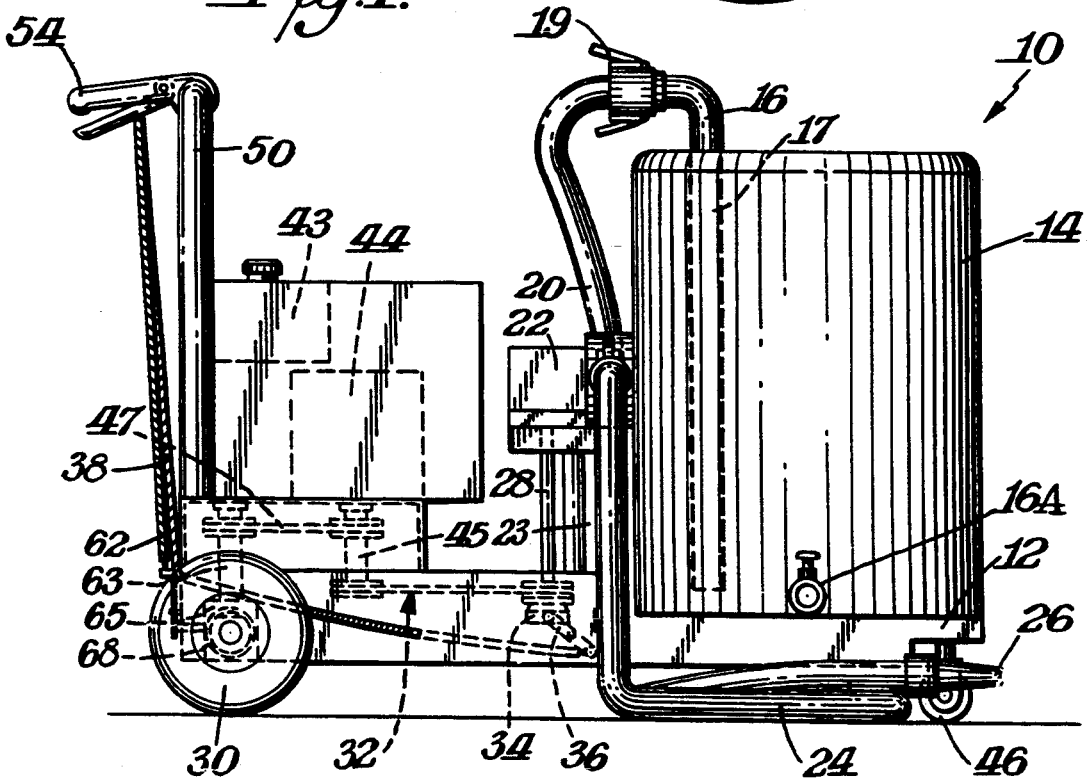
FIG. 1 is a side elevational view of a device for emptying the sewage holding tank of a boat in accordance with this invention.

FIG. 1 shows a portable boat sewage device 10 according to the present invention. The portable boat sewage device 10 includes a frame 12. A storage tank 14 is mounted to the front of the frame 12. The tank 14 is for holding the sewage pumped from the boats. The tank 14 is capable of holding over 900 lbs. of sewage when full. The tank 14 is light weight when it is empty. The tank 14 can be made of any suitable materials such as plastic, PVC, metal, etc. The tank could have a disconnect at the bottom of the tank that would be capable of being used when draining or emptying the full tank 14. Or optionally a pump discharge hose 20 could be connected to the top of storage tank 14 through a quick disconnect 19 and fitting 16. From this fitting 16 there could be a pipe 17 going into the tank 14 reaching almost to the bottom of the tank. Preferably the pipe 17 could be approximately 1 inch from the bottom of the tank. The discharge hose 20 could be mounted into the sewage pump 22 through quick connect 18. The sewage from the boat could travel through the quick connect 18, charge hose 20, quick connect 19, fitting 16, pipe 17 and empty into the tank 14. An inlet hose 24 could be mounted or attached to the sewage through quick connect 25. At the end of inlet hose 24 could be mounted a nozzle 26.

Figure 2:
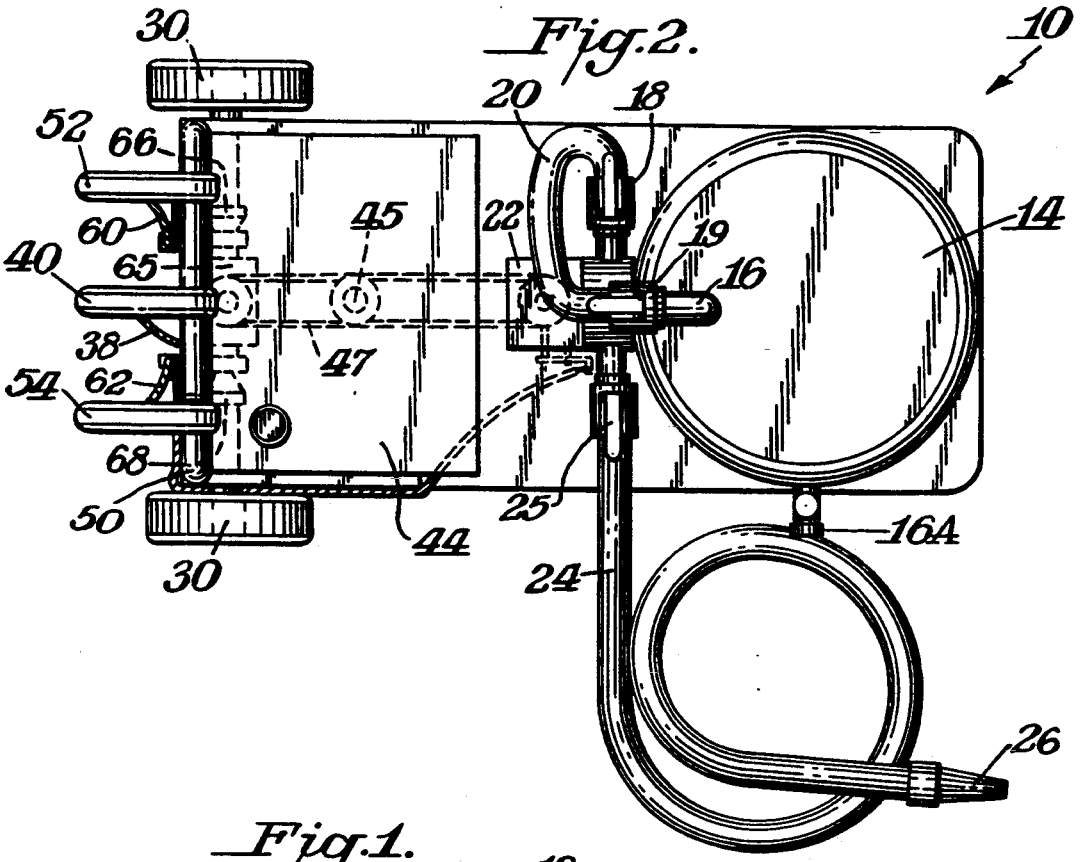
FIG. 2 is a top plan view of the device of FIG. 1.
Figure 3:
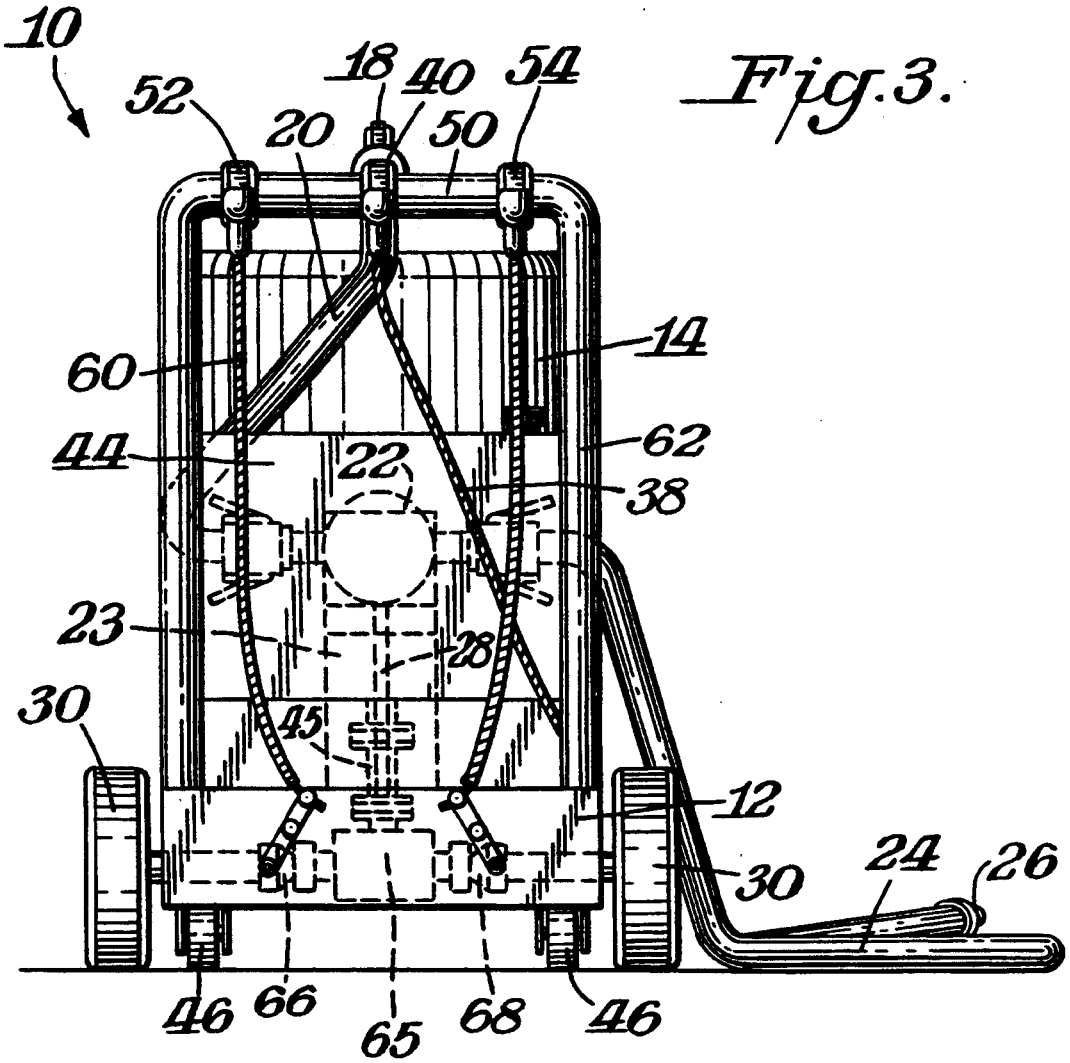
FIG. 3 is a rear elevational view of the device of FIGS. 1 and 2.

A bracket 23 could be mounted to the frame 12 and to the sewage pump 22 thereby holding the sewage pump in the desired position. The jack shaft 28 drives the sewage pump 22. Two rear wheels 30 could be mounted to the frame 12. The rear wheels 30 would preferably be mounted on the outside of the frame so that the wheel is not underneath the frame. If the rear wheels 30 are mounted underneath the frame, there would have to be enough clearance in the frame to allow the wheels to rotate without any hinderance from the frame. The rear wheels 30 are shown independently clutch controlled so they are free to rotate independent of each other for better maneuverability. Also mounted to the frame 12 could be a pulley drive assembly 32. The pulley drive assembly 32 would provide the power to engage the pump 22. The pulley drive assembly 32 could be mounted to a pump clutch 34. Mounted to the pump clutch 34 could be a clutch engage lever 36. A cable 38 could be connected to the clutch engage lever 36. The cable 38 could be mounted to a clutch control 40 (as shown in FIG. 2). The clutch control 40, 52, and 54 could be mounted to the handle assembly 50 (as shown in FIGS. 1 through 3). The handle assembly 50 could be mounted to the frame 12. The handle assembly 50 could also be adjustable anywhere between a vertical to a horizonal position (not shown) depending on the users preference. When the clutch control 40 is engaged, the cable 38 would tightened and pull on the clutch 36 thereby activating the pulley drive assembly 32 and the pump 22 would thereby be activated via jackshaft 28. An engine 44 could also be mounted to the frame 12. A jack shaft 45 could connect the engine 44 to a pulley drive assembly 32, to drive pump 22 and wheels 30. The jack shaft 45 could be made from any desirable material such as but not limited to metal or plastic. In addition, there could be at least one front swivel wheel 46. Optimally there would be two front swivel wheels 46. The front wheels 46 could be mounted underneath the frame 12 as shown in FIGS. 1–3 or mounted outside the frame similar to the rear wheels 30 as shown in FIGS. 1–3. The front wheels could also be clutch controlled. However, it is preferable if the front wheels are swivel wheels and the rear wheels are clutch controlled in order to have better maneuverability of the device. The user could engage just one rear wheel to allow the device to pivot more easily. Depending on which way the user wanted to turn would depend on which rear clutch the user would engage. If both rear wheels are engaged, the device will move forward very easily.

FIG. 2 shows a top plan view of the portable boat sewage assembly of this invention. As shown in FIG. 2 a steering bar 50 mounted to the frame 12. Mounted to the steering bar would be left clutch control 52 and a right clutch control 54 and a pump clutch control 40. A cable 60 could be connected to the left clutch control 52 and making it possible for the user engage control of the left wheel. A cable 62 could be connected to the right clutch control 54 and making it possible for the user to engage the control of the right wheel. A cable 38 could be connected to the pump clutch control 40 and making it possible for the user to activate the pump. When the cables 38, 60, and 62 are pulled tight this pulling of the cable would engage the clutch causing the wheels or pump to become activated. Also shown in FIG. 2 is the fuel compartment 43 for the engine 44.

FIG. 3 shows the clutch cable 60 could be connected to the left clutch control 52 and connected to the left clutch 66. When the user squeezes the left clutch control 52 the cable 60 becomes taught and engages the left clutch 66, thereby allowing the left wheel 30 to move. The right clutch cable 62 could be connected to the right clutch control 54 and connected to the right clutch 68. When the user squeezes the right clutch control 54, which pulls the right cable 62 taught and engages the right clutch 68 thereby allowing the right wheel 30 to move. The pump cable 38 is connected to the pump control 40 and the pump clutch 34. Also shown in FIG. 3 is drive jack shaft 63 that powers wheels 30 through a transmission 65 and respective the right wheel clutch 68 and left wheel clutch 66. The drive transmission 65 could be mounted inside the frame 12. Transmission 65 is driven by belt drive 47. Belt drive 47 could be connected to jack shaft 45 from the engine 44.

The nozzle 26 could be placed in the hole of sewage tank on the outside of the boat. The engine 44 could be turned on and the clutch engage lever 40 could be squeezed thereby activating the pump via jack shaft 28 and drive belt assembly 32. The pump suction generated from the pump could transport the sewage in the boat through the inlet hose 24. The sewage could flow through the inlet hose 24 to the discharge hose 20 and enter into the tank 12. The user than would engage the rear wheel clutch controls 52 and 54 and thereby move the device to the next boat to be drained. Upon finishing draining the boats of sewage the user could transport the device and empty the sewage at a proper disposal cite. The tank 14 is emptied by disconnecting the quick connects 25 and 18. Then quick connect 18 is connected to the inlet of the pump (where 25 was connected). Another discharge hose 20 with a quick connect on one end is then connected to the outlet of the pump (where 18 was before). This hose discharges into a larger tank for transport to the sewage plant or the hose can discharge into a stationary holding tank or directly into the sewer system. The engine 44 would be turned on thereby activating the pump 22 and causing the pump to pull a vacuum and transport the sewage out of the tank 14 through the hose 20, through the pump 22 and through the inlet hose 24 and into the proper disposal area. Then when the pump is engaged, the tank is emptied through the vertical pipe 17 inside tank through fitting 16. Another way to pump the sewage out of the tank 14, the user could connect an additional discharge hose to an outlet valve 16A at the bottom of the tank. The outlet valve could be turned to the open position, thereby allowing the sewage to drain by the use of gravitional force. In addition, the pump could be engaged to drive air into the tank and force the sewage out of the tank and through the discharge hose and into the holding tank or sewage system. The last method of disposal of the sewage is to remove the tank 14 and drain sewage from the tank by conventional means.

Hoses 20 and 24 could be connected to the system by quick disconnects 18, 19 and 25. This would allow for quick changing of the system from filling to emptying the tank 14. To empty the tank 14, hose 20 is disconnected from the outlet of the pump at quick connect 18 and connected to the pump at quick connect 25. Another outlet hose (not shown on drawings) is connected to pump outlet at quick connect 18. The discharge of this outlet hose is into a sewage system or a larger holding tank. When tank 14 is emptied, the sewage passes through pipe 17, fitting 16, quick connect 19, hose 20, into inlet of sewage pump and is charged into hose connected to discharge of pump. Quick disconnects 18, 19 and 25 would allow for easy cleaning of the system and for replacement of the hoses upon wear.

The portable boat sewage device 10 is compact in size so it is easily transported on a trailer that is towed behind a vehicle. Device 10 could also be designed to be directly attached to a vehicle trailer hitch.

What I Claim:

1. A self propelled device for emptying a sewage holding tank of a boat comprising: a frame, a tank mounted to said frame for the storage of sewage from the boat, an engine mounted to said frame, a pump mounted to said frame, said pump comprising means for pumping sewage from said sewage holding tank, said pump being operated by said engine, at least one pair of hoses, one of said hoses being a discharge hose having one end connected to said tank and the other end mounted to said pump and another of said hoses being a second hose which is an intake hose having one end mounted to said pump and the other end being free, at least one pair of wheels mounted to and extending at least partially below said frame to facilitate the transportability of said device, and where said device being self propelled.

2. A device as claimed in claim 1, wherein there are two rear wheels and at least one front wheel.

3. A device as claimed in claim 2, wherein said two rear wheels are clutch controlled.

4. A device as claimed in claim 2, wherein said two rear wheels are independently clutch controlled.

5. A device as claimed in claim 4, further comprising a quick disconnect mounted to said discharge hose.

6. A device as claimed in claim 1, wherein there is at least one front wheel which is a swivel wheel.

7. A device as claimed in claim 1, wherein said engine operates a pump through a drive assembly and clutch attached to a jack shaft attached to said pump.

8. A device as claimed in claim 1, further comprising a quick disconnect mounted to said intake hose.

9. A device as claimed in claim 1, further comprising a nozzle connected to the end of said second hose.

10. A device as claimed in claim 1, wherein the discharge hose is connected to the top of the tank.

11. A device as claimed in claim 1, further comprising an handle connected to the frame.

12. A device as claimed in claim 11, further comprising at least one clutch control mounted to said handle.

13. A device as claimed in claim 12, wherein there is a clutch control for the rear wheels.

14. A device as claimed in claim 12, wherein there are two rear wheels comprising a right rear wheel and a left rear wheel, a clutch control for said right rear wheel, a clutch control for said left rear wheel and a clutch control for said pump.

15. A device as claimed in claim 1, wherein said tank has an outlet valve at the bottom of said tank.

* * * * *